US007959764B2

(12) United States Patent
Ringer et al.

(10) Patent No.: US 7,959,764 B2
(45) Date of Patent: Jun. 14, 2011

(54) FORMING FABRICS FOR FIBER WEBS

(75) Inventors: Martin Ringer, Lones (GB); Daniel Shorkey, Benton, LA (US); Blake Hender, Shreveport, LA (US)

(73) Assignee: Voith Patent GmbH, Heindenheim (DE)

( * ) Notice: Subject to any disclaimer, the term of this patent is extended or adjusted under 35 U.S.C. 154(b) by 903 days.

(21) Appl. No.: 11/762,367

(22) Filed: Jun. 13, 2007

(65) Prior Publication Data

US 2008/0308247 A1 Dec. 18, 2008

(51) Int. Cl.
*D21F 5/02* (2006.01)
*D21F 1/10* (2006.01)
*D03D 3/02* (2006.01)

(52) U.S. Cl. ..... 162/358.5; 162/348; 139/383 A

(58) Field of Classification Search ..... 162/348, 162/116, 362, 900–904, 358.1, 358.3, 358.5, 162/359.1; 139/383 A, 383 AA, 425 A
See application file for complete search history.

(56) References Cited

U.S. PATENT DOCUMENTS

| | | | | |
|---|---|---|---|---|
| 3,224,928 | A | 12/1965 | Lee et al. | 162/214 |
| 4,501,303 | A * | 2/1985 | Osterberg | 139/425 A |
| 4,729,412 | A * | 3/1988 | Bugge | 139/383 A |
| 5,152,326 | A * | 10/1992 | Vohringer | 139/383 A |
| 5,219,004 | A | 6/1993 | Chiu | 139/383 |
| 5,454,405 | A * | 10/1995 | Hawes | 139/383 A |
| 5,482,567 | A | 1/1996 | Barreto | |
| 5,826,627 | A * | 10/1998 | Seabrook et al. | 139/383 A |
| 6,103,067 | A * | 8/2000 | Stelljes et al. | 162/348 |
| 6,202,705 | B1 * | 3/2001 | Johnson et al. | 139/383 A |
| 6,454,904 | B1 | 9/2002 | Herman et al. | 162/205 |
| 6,581,645 | B1 * | 6/2003 | Johnson et al. | 139/383 A |
| 6,854,488 | B2 * | 2/2005 | Hay et al. | 139/383 A |
| 7,604,025 | B2 * | 10/2009 | Quigley | 139/383 A |
| 2005/0167061 | A1 | 8/2005 | Scherb et al. | |
| 2005/0167066 | A1 | 8/2005 | Herman et al. | 162/203 |
| 2006/0060321 | A1 * | 3/2006 | Quigley et al. | 162/203 |
| 2006/0243339 | A1 | 11/2006 | Hay | |

FOREIGN PATENT DOCUMENTS

| | | |
|---|---|---|
| WO | WO 2005/075732 | 8/2005 |
| WO | WO 2005/075736 | 8/2005 |

* cited by examiner

*Primary Examiner* — Eric Hug
(74) *Attorney, Agent, or Firm* — Taylor IP, P.C.

(57) ABSTRACT

A paper machine having a forming fabric with a paper side plurality of weft and warp yarns interwoven to form a layer contacting a paper web. A plurality of weft and warp yarns are interwoven to form a machine side layer for the forming fabric. A plurality of warp binder yarns are interlaced with the paper side and machine side yarns to form a multiple layered forming fabric. The weft yarns in the machine side layer are greater in diameter than the warp yarns for maintaining width stability of the fabric. The fabric is characterized by high permeability, high void volume and a high Beran's Fiber Support Index.

26 Claims, 4 Drawing Sheets

FORMING FABRICS FOR FIBER WEBS

BACKGROUND OF THE INVENTION

1. Field of the Invention

The present invention relates to fabrics employed in web forming equipment such as papermaking and non-woven web forming equipment, and, more particularly, to forming fabrics in web forming equipment or papermaking machines.

2. Description of the Related Art

Paper is manufactured by conveying a paper furnish consisting of a slurry of cellulose fibers, water and appropriate additives onto a forming fabric or between two forming fabrics in a forming section of a paper machine. The sheet is then passed through a pressing section and ultimately through a drying section of a papermaking machine. In the case of standard tissue paper machines, the paper web is transferred from the press fabric to a Yankee dryer cylinder and then creped.

An essential part of the performance of a fabric is drainage and fiber retention. Currently, triple layer woven structures are employed for these applications due to their high dewatering capacity, fine forming surface, and high degree of width stability. New tissue making technologies associated with through air drying (TAD) place ever increasing demands on the forming fabric. Another approach to drying, offered by Voith Paper under the name ATMOS, and more completely described in International Patent Application Publication WO 2005/075736 A3 places even greater demands on the fabric. In this system, the fibrous web is carried around a partial arc of a drum and exposed to vacuum to remove water from the fibrous web.

Current triple layer woven forming fabrics are cross-machine direction bound which forms an impediment to the high drainage needed in such applications and the very fine forming surface needed for sheet formation. In other words, the sheet form needs to be well filled in, have a uniform basis weight distribution and minimal pin holes.

Thus, there exists a need in the art to provide a forming fabric that has increased width stability, drainage and fiber support means.

Furthermore, a need exists for ever increasing capacity and stability with respect to these parameters as paper forming technologies impose demands of ever increasing speed.

SUMMARY OF THE INVENTION

The invention, in one form, is directed to a paper machine for drying a paper or fibrous web. The paper machine has at least one station where the paper or fibrous web has its moisture content reduced. A forming fabric carries the paper or fibrous web at least to the station. The forming fabric has a plurality of paper side weft and warp yarns interwoven to form a fabric contacting the paper or fibrous web. A plurality of machine side weft and warp yarns are interwoven to form a machine side layer for the forming fabric. A plurality of binder yarns are interlaced with a plurality of the paper side and machine side yarns to form a multiple layered forming fabric. The weft yarns in the machine side layer are greater in diameter than the warp yarns for maintaining with stability of the fabric.

An advantage of the present invention is the provision of a forming fabric having increased width stability while at the same time allowing for superior drainage and fiber support.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
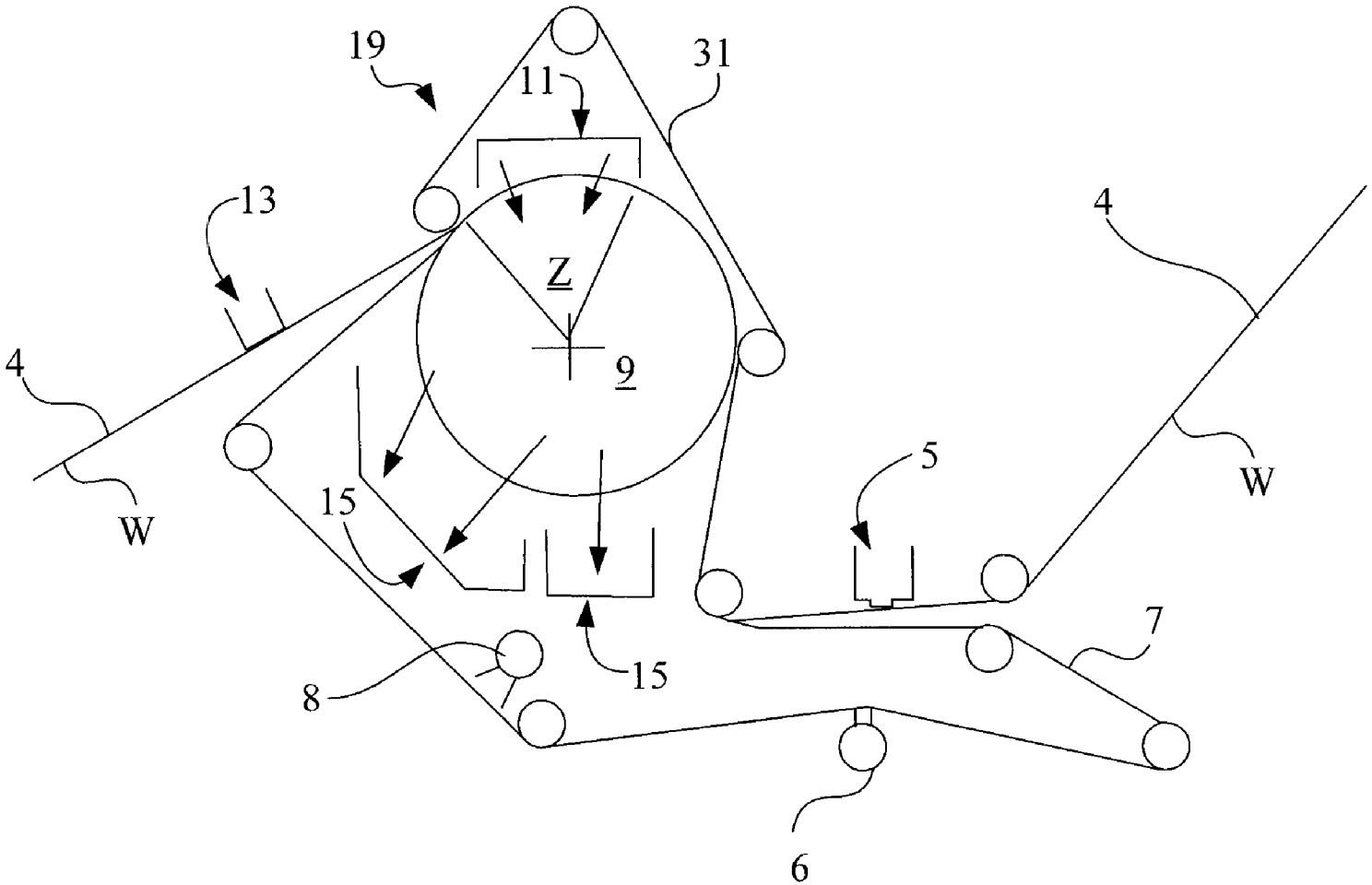
FIG. 1 is a schematic view of a dewatering system with which the present invention is used.

Referring now to the drawings, FIG. 1 shows a diagram of a dewatering system that utilizes a main pressure field in the form of a belt press generally indicated by reference character 19. A web W of fiber material is carried by a structured fabric 4 to a vacuum box 5 that is required to achieve a solids level of between approximately 15% and approximately 25% on a nominal 20 grams per square meter (gsm) web-running at between approximately −0.2 and approximately −0.8 bar vacuum, and can, in preferred form, operate at a level of between approximately −0.4 and approximately −0.6 bar. A vacuum roll 9 is operated at a vacuum level of between approximately −0.2 and approximately −0.8 bar. Preferably, it is operated at a level of approximately −0.4 bar or higher. The belt press 19 includes a single fabric run 31 capable of applying pressure to the non-sheet contacting side of the structured fabric 4 that carries the web W around the suction roll 9. The fabric 31 is a continuous or endless circulating belt guided around a plurality of guide rolls and is characterized by being permeable. An optional hot air hood 11 is arranged within the belt 31 and is positioned over the vacuum roll 9 in order to improve dewatering. In addition, steams showers (not shown) may be positioned within hood 11 upstream of vacuum roll 9 to enhance the dewatering process. The vacuum roll 9 includes at least one vacuum zone Z and has a circumferential length of between approximately 200 mm and approximately 2500 mm, preferably between approximately 800 mm and approximately 1800 mm, and more preferably between approximately 1200 mm and approximately 1600 mm. The thickness of the vacuum roll shell can preferably be in the range of between approximately 25 mm and approximately 75 mm. The mean airflow through the fabrics in the area of the suction zone Z can be approximately 150 $m^3$/min per meter machine width. The solids level leaving the suction roll 9 is between approximately 25% and approximately 55% depending on the installed options, and is preferably greater than approximately 30%, is more preferably greater than approximately 35%, and is even more preferably greater than approximately 40%. An optional pick up vacuum box 13 can be used to make sure that the sheet or web W follows the structured fabric 4 and separates from a dewatering fabric 7. It should be noted that the direction of air flow in a first pressure field (i.e., vacuum box 5) and the main pressure field (i.e., formed by vacuum roll 9) are opposite to each other. The system may also utilize one or more shower units 8 and one or more Uhle boxes 6.

There is a significant increase in dryness with the belt press 19. The belt 31 should be capable of sustaining an increase in belt tension of up to approximately 80 KN/m without being destroyed and without destroying web quality. There is roughly about a 2% more dryness in the web W for each tension increase of 20 KN/m.

The dewatering system shown in FIG. 1 places high demands on the dewatering fabric 7 to provide increasing water drainage and uniform sheet formation. The performance of dewatering fabric 7 establishes the effectiveness of the system because sufficient dryness of the web W as it enters the belt press 19 enables increased processing speeds.

Figure 2:
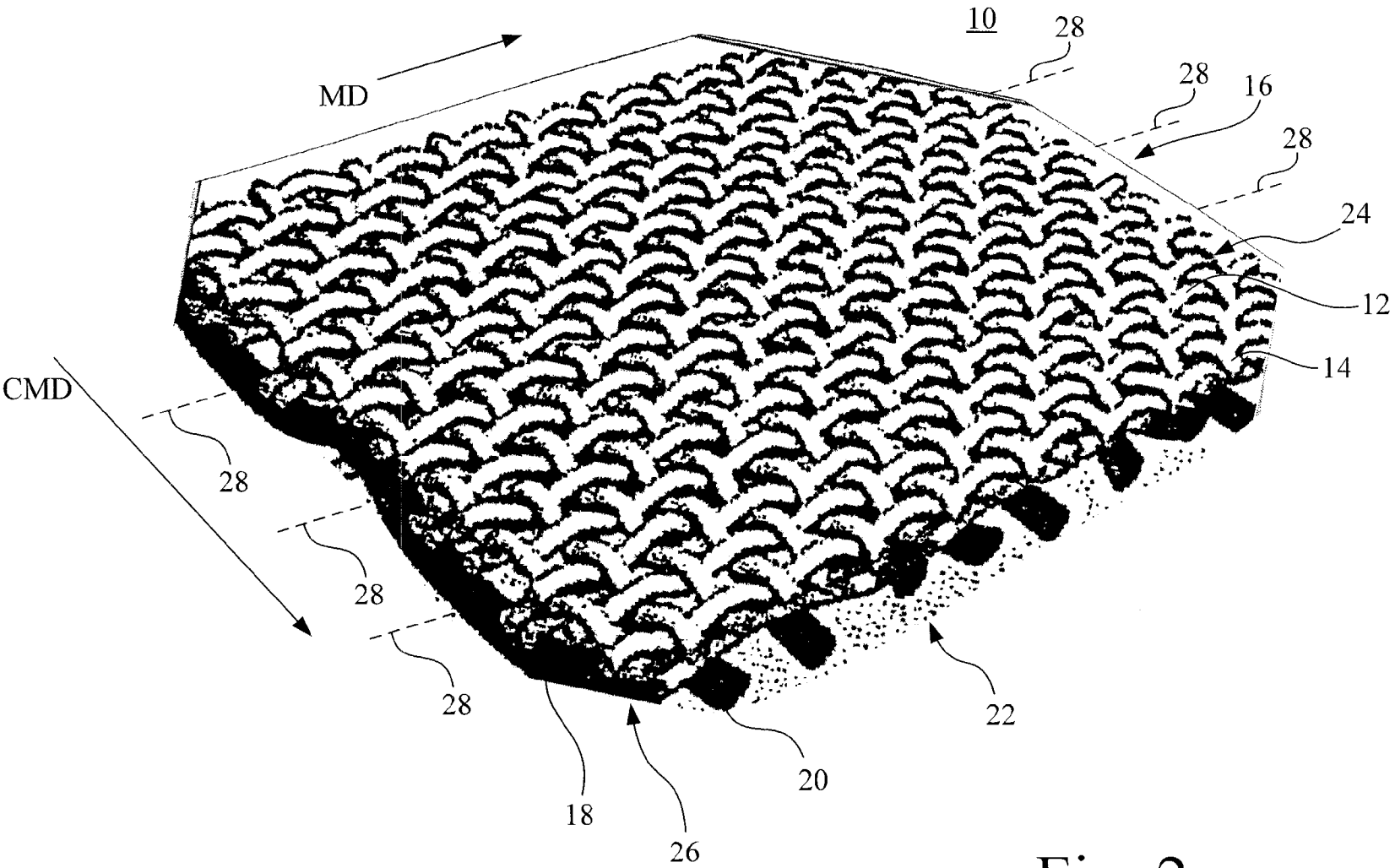
FIG. 2 is a perspective view of a multiple layer fabric embodying one form of the present invention.

Referring now to FIG. 2, there is shown a forming fabric 10 that is positioned ahead of the dewatering apparatus of FIG. 1. having a plurality of warp yarns 12 interwoven with weft yarns 14 to form a paper or fibrous web side layer 16. Warp yarns 12 extend in a machine direction (MD) and weft yarns 14 extend in a cross machine direction (CD). As shown in FIG. 2, arrow MD indicates the machine direction for the fabric. In other words, the MD direction is the length of the fabric and the CD, indicated by the appropriate arrow, is the width of the fabric. When the fabric is in a belt form, it is continuous.

An additional set of warp yarns 18 and weft yarns 20 are interwoven with each other and form an additional layer which ends up being the machine facing side 22. The machine facing side 22 usually abuts a drive drum or guide roller (not shown to simplify the discussion of the present invention) to move the belt 10 through a prescribed path. The interwoven weft and warp yarns 14 and 12, respectively form a paper side layer 24 and the weft and warp yarns 18 and 20 form a machine side layer 26. Layers 24 and 26 are connected by binder yarns 28, illustrated by dashed lines extending beyond the illustrated perimeter of the fabric 10. Only a portion of the binder yarns 28 are shown to simplify the understanding of the present invention. As shown in FIG. 2, the binder yarns 28 extend in a warp or MD direction to bind the layers 24 and 26 into a multiple layer fabric. The advantage of the binder yarns 28 extending in an MD direction is enhanced drainage of the fabric 10. The MD yarn sizes are made small to keep the fabric as thin as possible. The MD yarn diameters are less than 0.17 mm, and preferably less than 0.15 mm and preferred less than 0.13 mm. The CD yarn diameters, at least on the machine facing side, are greater than 0.22 mm to enhance width stability. The result of this selection of yarn diameter is a caliper, preferably less than 0.030 inches, to enhance drainage through the fabric 10.

The yarns making up the paper side layer 24 and the machine side layer 26 are interwoven in such a way that the permeability of the fabric 10 is broadly between about 300 cfm and about 1000 cfm. A preferred range is between about 450 cfm and about 1000 cfm, but the most preferred range is between about 525 cfm to about 700 cfm to maximize drainage. The void volume is between about 40% to about 80% and preferred is about 60% to 80%. The most preferred void volume is from about 65% to 80%. This high void volume is needed to handle the very high dewatering rate of the fabric 10.

The yarns making up the paper side layer 24 and the machine side layer 26 are also interwoven so that the surface open area is between about 20% to about 60% with a preferred open area being from about 30% to about 60%. The most preferred is from about 35% to about 45%. The high surface open area is needed for very fast dewatering demand.

The fabric is also interwoven in a way to achieve certain levels of Beran's Fiber Support Index (FSI). As used herein, the FSI, is defined in Robert L. Beran "The Evaluation and Selection of Forming Fabrics" TAPPI, April 1979, Volume 62, Number 4, which is hereby incorporated herein by reference. The FSI for the resulting fabric is the range of from about 100 to about FSI 250 with a more preferred FSI being about 125 to about 250. The most preferred FSI is from about 150 to about 250. A high FSI value is needed for fiber retention, sheet formation and to minimize pin holes that result from excessively fast dewatering with insufficient fiber support. This in turn results in fiber being pulled through the fabric and sheet holes resulting therefrom.

Figure 3:
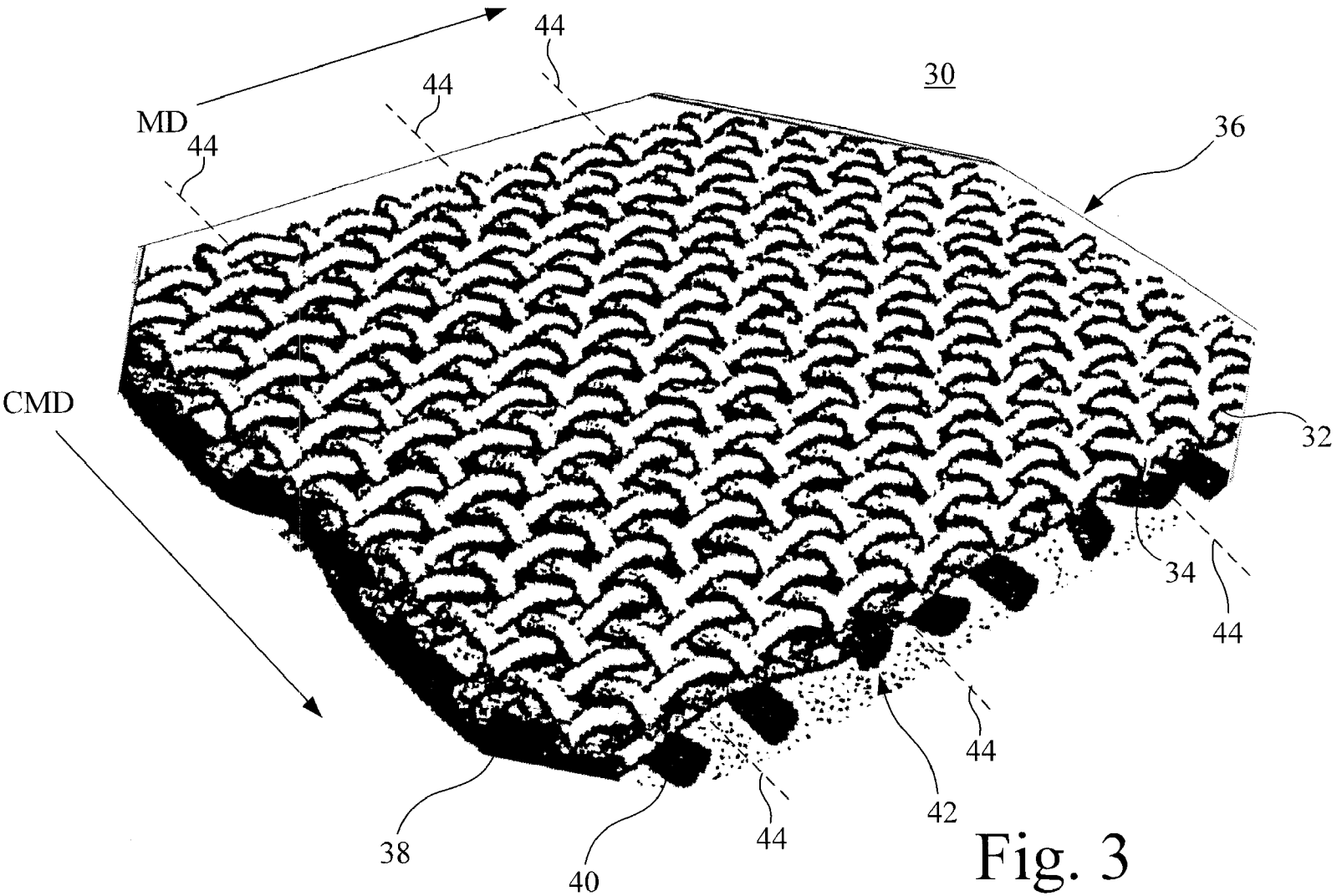
FIG. 3 is a perspective view of another form of the invention.

The fabric shown in FIG. 2 enables a significant advance in performance in the forming and dewatering of a fibrous web. The fabric 10 shown in FIG. 2 has MD binding yarns 28. However, the fabric 30 shown in FIG. 3 has the binding yarns running in a CD direction. As shown in FIG. 3, a plurality of warp yarns 32 and weft yarns 34 are interwoven to form a paper side layer 36. Additional warp yarns 38 and weft yarns 40 are interwoven to form a machine side layer 42. A plurality of binder yarns 44, shown by dashed lines extending beyond the described parameter of fabric 30, are interwoven between layers 36 and 42 to provide a multilayered fabric. In order to simplify the understanding of the present invention, only a portion of the binder yarns 44 are illustrated. Although the permeability of such an arrangement is not as high as the fabric shown in FIG. 2 it still offers significant benefits in dewatering a fibrous web.

The weaves shown in FIGS. 2 and 3 are plain weaves, but it should be apparent to those skilled in the art, that other forms of weaves may be employed and still realize the benefits of the present invention. By virtue of the CD yarn domination, the width stability of the forming fabric running on a machine can achieve contraction values of less than 1%. The fabric may be formed from a variety of materials for the yarns and treatments may be given to the fabric for providing improved life, stability, and cleanliness.

Figure 4:
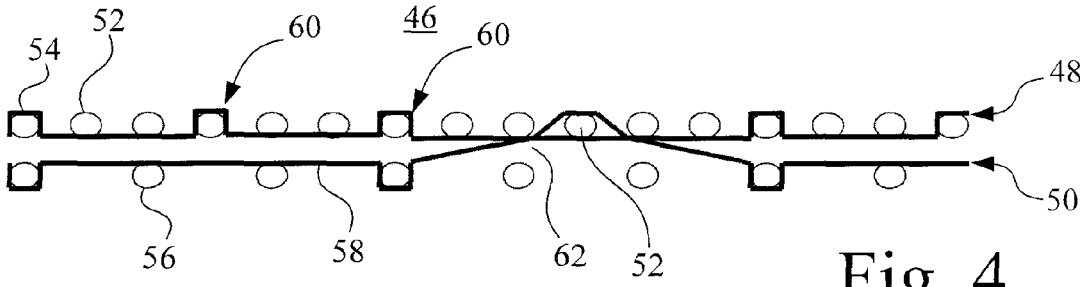
FIGS. 4, 5 and 6 show alternative ways in which binder yarns may be woven in the fabrics of FIG. 2.

Referring to FIG. 4, there is shown a cross-section of a forming fabric 46 formed from a fibrous web side fabric 48 and a machine side fabric 50. The details of the complex weave of warp and weft yarns within these fabrics is not shown to simplify an understanding of the present invention. Furthermore, the cross-sections shown in this figure and subsequent figures are representative and are not exact for each section taken across the width of the fabric. Fibrous web side fabric 48 is formed from a plurality of interwoven weft yarns 52 and warp yarns 54, only one warp yarn of which is shown. Machine side fabric 50 has a series of interwoven weft yarns 56 and warp yarns 58, only one warp yarn of which is shown. The warp yarn 58 of fabric 50 crosses over at 62 to a selected weft yarn 52 of fabric 48 to interweave the fabrics 48 and 50. In this case the warp yarn 58 selectively connects to weft yarns of the adjacent fabric to function as the binder yarn. Also, at point 62 the warp yarn 54 of fabric 48 drops out of the weaving pattern for the fabric 48 and is replaced by the warp yarn 58 of fabric 50. It should be apparent to those skilled in the art that the manner in which the weft yarns form binder yarns can vary across the width of the fabric as appropriate for the particular application.

Figure 5:
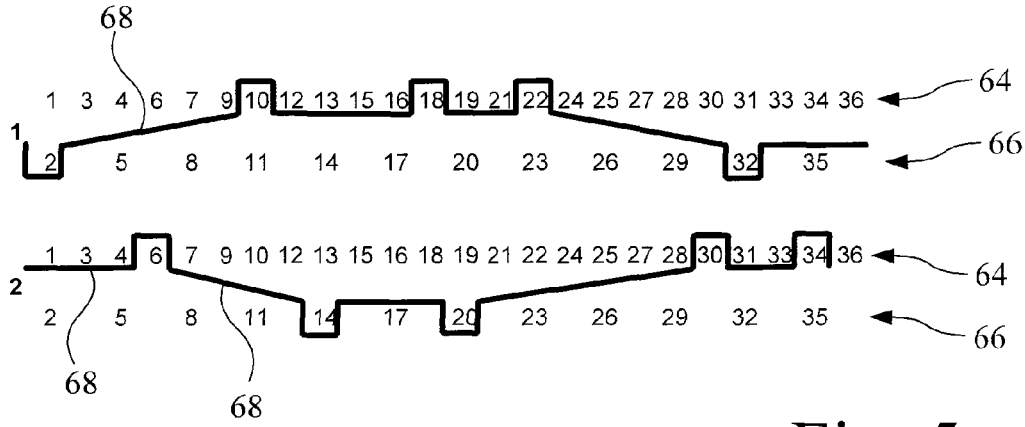

FIG. 5 shows yet another form of interweaving the binder yarns to join adjacent fabrics. In FIG. 5, the fibrous web side fabric 64 is adjacent the machine side fabric 66. The weft yarns of each of the fabrics are represented by the numbers adjacent one another. The binder yarn 68 extends in an MD direction and selectively passes from one fabric layer to the other to form binding between the two. As shown in FIG. 5, the binder yarn 68 passes over uneven numbers of weft yarns in the adjacent fabric 64 as appropriate for binding the fabrics. The pattern at the upper portion of fabric 64 shows the warp yarn 58 passing over a $5^{th}$ weft yarn followed by passing over a $3^{rd}$ weft yarn and then back to the fabric 66. The lower portion of FIG. 5 shows another portion of the width of the fabrics 64 and 66 to show yet another way in which the binder yarn 68 may be interwoven.

Figure 6:
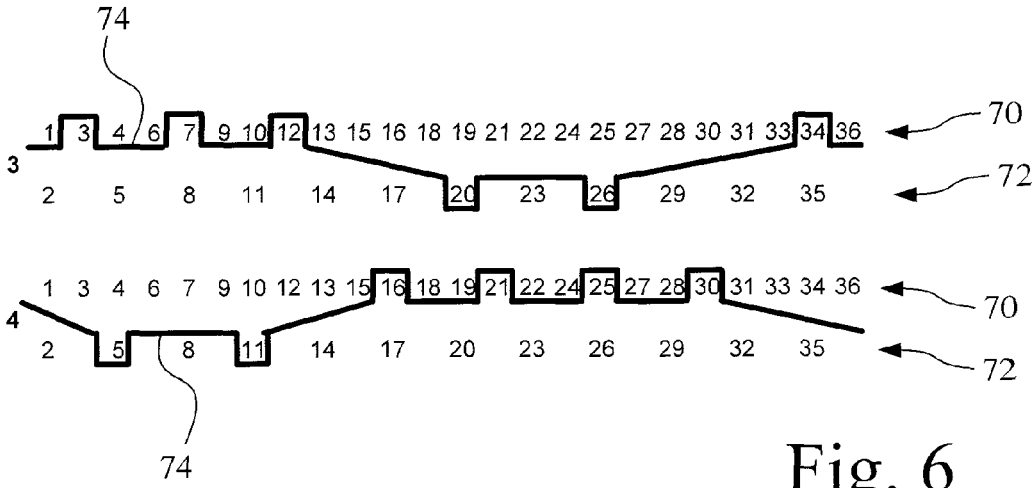

FIG. 6 shows still another variation in which a fibrous web side fabric 70 is adjacent a machine side fabric 72. The warp binder yarns 74 pass under an equal number of weft yarns in the adjacent fabric before passing over a weft yarn as it interweaves with the weft yarns of fabric 70. Thus it is shown that the warp binder yarns provide the dual function of interweaving the various fibrous web side fabric and machine side fabrics as well as binding the two fabrics together.

The above structures while exemplary provide a forming fabric that has superior ability to eliminate water from the web carried by the fibrous web side. This superior water capacity minimizes, if not eliminates, the need for supplemental vacuum operations in the paper machine of FIG. 1 that add complication and cost to the overall system.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine for drying a fibrous web, said paper machine comprising:

at least one station wherein the fibrous web has its moisture content reduced, said station having a permeable fabric carrying the web over a drying apparatus, a permeable dewatering fabric contacting the web and being guided over the drying apparatus and a mechanism for applying pressure to the permeable fabric, the web, and the dewatering fabric at the drying apparatus;

a forming fabric for carrying the fibrous web to a location ahead of said station, said forming fabric comprising:

a plurality of web side weft and warp yarns interwoven to form a fabric contacting the fibrous web;

a plurality of machine side weft and warp yarns interwoven to form a machine side fabric for said forming fabric; and a plurality of warp yarns of one of said machine side and web side fabrics interlaced with the plurality of weft yarns of the other of said web side and machine side fabrics to form a multiple layered forming fabric having a significant permeability, wherein each of said warp yarns pass over a plurality of weft yarns of the other of said web side and machine side fabrics before returning to the said one of said machine side and web side fabric.

2. A paper machine as claimed in claim 1, wherein said yarns are interwoven in such a manner that the permeability of the fabric is between about 300 cfm and 1000 cfm.

3. A paper machine as claimed in claim 1, wherein the yarns are interwoven in such a manner that the permeability of the fabric is between about 450 cfm and about 1000 cfm.

4. A paper machine as claimed in claim 1, wherein said yarns are interwoven in such a manner that the permeability of the fabric is between about 525 cfm and about 700 cfm.

5. A paper machine as claimed in claim 1, wherein the yarns are interwoven in such a manner that the void volume is between about 40% and about 80%.

6. A paper machine as claimed in claim 1, wherein the yarns are interwoven in such a manner that the void volume is between about 60% and about 80%.

7. A paper machine as claimed in claim 1, wherein the yarns are interwoven in such a manner that the void volume is between about 65% and about 80%.

8. A paper machine as claimed in claim 1, wherein the yarns are interwoven so that the surface open area of said paper forming fabric is between about 20% and about 60%.

9. A paper machine as claimed in claim 1, wherein the yarns are interwoven so that the surface open area of said paper forming fabric is between about 30% and about 60%.

10. A paper machine as claimed in claim 1, wherein the yarns are interwoven so that the surface open area of said paper forming fabric is between about 35% and about 45%.

11. A paper machine as claimed in claim 1, wherein said yarns are interwoven in such a manner that the Beran's Fiber Support Index is between about 100 and about 250.

12. A paper machine as claimed in claim 1, wherein said yarns are interwoven in such a manner that the Beran's Fiber Support Index is between about 125 and about 250.

13. A paper machine as claimed in claim 1, wherein said yarns are interwoven in such a manner that the Beran's Fiber Support Index is between about 150 and about 250.

14. A paper machine as claimed in claim 1 wherein the diameter of the machine side weft yarns is greater than the warp yarns for maintaining width stability of said fabric.

15. A paper machine as claimed in claim 14, wherein the caliper of the fabric is less than 0.030 inches.

16. A paper machine as claimed in claim 14, wherein the diameter of said warp yarns is less than 0.17 mm.

17. A paper machine as claimed in claim 14, wherein the diameter of said warp yarns is less than 0.15 mm.

18. A paper machine as claimed in claim 14, wherein the diameter of said warp yarns is less than 0.13 mm.

19. A paper machine as claimed in claim 14, wherein the weft yarns in the layer adjacent the machine side of said fabric are greater than 0.22 mm.

20. A paper machine as claimed in claim 1, wherein said warp yarns are interweaved with weft yarns of one of said fabrics and periodically pass over a weft yarn of the other fabric.

21. A paper machine as claimed in claim 20, wherein the warp fabric for the other of said fabrics drops out of its fabric at the point at which the warp yarn passes over said weft yarn.

22. A paper machine as claimed in claim 1, wherein said warp yarns pass over three weft yarns.

23. A paper machine as claimed in claim 1, wherein said warp yarns pass over five weft yarns.

24. A paper machine as claimed in claim 1 wherein said warp yarns pass over four weft yarns of the other fabric.

25. A paper machine as claimed in claim 1, wherein said warp yarns pass under an equal number of weft yarns between selected weft yarns over which the warp yarn passes.

26. A paper machine as claimed in claim 1, wherein said warp yarns pass under an unequal number of weft yarns between selected weft yarns over which the warp yarn passes.

* * * * *